United States Patent [19]

Suzuki et al.

[11] Patent Number: 4,592,646

[45] Date of Patent: Jun. 3, 1986

[54] IMAGE FORMING APPARATUS WITH CONTROL FOR IMAGE FORMING CONDITIONS

[75] Inventors: Koji Suzuki, Yokohama; Jyoji Nagahira; Kouki Kuroda, both of Tokyo, all of Japan

[73] Assignee: Canon Kabushiki Kaisha, Tokyo, Japan

[21] Appl. No.: 692,048

[22] Filed: Jan. 16, 1985

Related U.S. Application Data

[63] Continuation of Ser. No. 360,684, Mar. 22, 1982.

[30] Foreign Application Priority Data

| | | | |
|---|---|---|---|
| Mar. 27, 1981 | [JP] | Japan | 56-44069 |
| Apr. 1, 1981 | [JP] | Japan | 56-47239 |
| Apr. 1, 1981 | [JP] | Japan | 56-47240 |
| Apr. 1, 1981 | [JP] | Japan | 56-47241 |

[51] Int. Cl.[4] ..... G03G 15/00

[52] U.S. Cl. ..... 355/14 R; 355/14 CH; 355/3 R

[58] Field of Search ..... 355/3 R, 14 CH, 14 R, 355/14 D, 14 E

[56] References Cited

U.S. PATENT DOCUMENTS

| | | | |
|---|---|---|---|
| 3,649,114 | 3/1972 | Vlach et al. | 355/14 CH X |
| 3,788,739 | 1/1974 | Coriale | 355/3 R X |
| 4,326,796 | 4/1982 | Champion et al. | 355/14 CH |
| 4,335,953 | 6/1982 | Tsuchiya et al. | 355/14 CH |
| 4,346,986 | 8/1982 | Kuge et al. | 355/14 CH |
| 4,348,099 | 9/1982 | Fantozzi | 355/14 CH X |
| 4,355,885 | 10/1982 | Nagashima | 355/14 CH |

*Primary Examiner*—A. C. Prescott

*Attorney, Agent, or Firm*—Fitzpatrick, Cella, Harper & Scinto

[57] ABSTRACT

There is disclosed an image forming apparatus capable of compensating for fluctuations in the image forming conditions thereby ensuring optimum image formation.

The image forming apparatus is provided with a control for modifying outputs from a processor for image formation when the length of pause in the image formation operation of the processor exceeds a predetermined value.

15 Claims, 13 Drawing Figures

IMAGE FORMING APPARATUS WITH CONTROL FOR IMAGE FORMING CONDITIONS

This is a continuation of application Ser. No. 360,684, filed Mar. 22, 1982.

BACKGROUND OF THE INVENTION

1. Field of the Invention

The present invention relates to an image forming apparatus for image formation on a sheet, such as a copier.

2. Description of the Prior Art

Conventional electrostatic recording apparatus such as electrophotographic copiers have been associated with the drawbacks that the charging characteristics of the recording member, i.e. photosensitive drum, are affected by environmental parameters such as moisture and also by time-dependent changes such as mechanical fatigue during use.

In order to compensate such environmental or time-dependent effects, there has been proposed a method of controlling the image recording conditions such as the conditions of charging, exposure, developing etc. to attain optimum formation in response to the detected potential of the latent image formed on the photosensitive drum, or a method of controlling the conditions of charging and exposure in response to the charging period to attain optimum image recording.

Such conventional methods are however defective in that the apparatus becomes inevitably expensive since the detector for the surface potential is complicated and expensive.

Also such conventional methods are unable to compensate for a rapid fluctuation in the charging characteristic of the photosensitive drum immediately after the start of electrostatic charging. Such fluctuation will hereinafter be referred to as initial fluctuation.

Said initial fluctuation of the photosensitive drum, a phenomenon that the charging characteristic shows a rapid fluctuation during a short period immediately after the start of electrostatic charging due to the past charging hysteresis before it reaches a stable state, has become a problem in recent years since the idle waiting time in the copiers has become limited due to the increasing copying speed. As shown by a curve in FIG. 1, the dark potential $V_D$, which is a drum surface potential formed by an exposure corresponding to a dark image area, shows an exponential change from an initial value $Vt_0$ to a final value $Vt_\infty$ according to a time constant $\tau_1$ when the charging is initiated at $t_0$ after a sufficiently long pause. Said potential change may appear in inverted form as represented by a curve B depending on the charging hysteresis, i.e. the charging state when the preceding charging is terminated.

Also if the charging is initiated for example at $t_2$ after an insufficiently long pause, the surface potential shows a change with the same time constant $\tau_1$ from a different initial value ($Vt_2$) to the afore-mentioned final value $Vt_\infty$, as shown by a curve A' or B'. Consequently the charge starting voltage varies from $Vt_\infty$ to $Vt_0$ with a time constant $\tau_2$ ($>\tau_1$) as shown by curves C and D in FIG. 1. In such situation the potential difference $\Delta E = Vt_\infty - Vt_0$ and the time constants $\tau_1$, $\tau_2$ vary according to the charging hysteresis and environmental parameters, particularly humidity, and show fluctuations among different production lots of the photosensitive drum. Such initial fluctuation of the potential causes a density difference between the first and second copies or within a copy.

Also such conventional control methods are not effective enough since a predetermined control factor is always used even for the deterioration of the photosensitive drum or a slow change in the environmental parameters, and are therefore unable to provide optimum image recording conditions. Furthermore, in such methods it is difficult to realize the desired recording conditions through frequently repeated control steps since the control procedure is not real-time and since the lamp utilized for forming light and dark image areas requires relatively long starting and extinguishing periods. Furthermore the eventual fluctuation of the characteristic between different production lots of the photosensitive drum necessitates lengthy adjustment procedure at each drum replacement in order to compensate the difference between the drum characteristic and the control factor, and such difference may retard the establishment of the optimum conditions or cause an excessive compensation giving rise to an unstable control.

SUMMARY OF THE INVENTION

The object of the present invention is to provide an image forming apparatus not associated with the conventional drawbacks and capable of compensating for fluctuations in the image forming conditions thereby ensuring optimum image formation.

Another object of the present invention is to provide an image forming apparatus capable of modifying the amount of compensation in the image forming conditions according to the change in the characteristic of the recording member and in response to the charging hysteresis relating to the length of pause before the start of image formation.

Still another object of the present invention is to provide an image forming apparatus capable of correcting the image forming conditions in response to the fluctuation of characteristic of the recording member at the start of charging step and also to the charging hysteresis.

Still another object of the present invention is to provide an image forming apparatus capable of modifying the image forming conditions in response to the length of pause before the start of image formation, detecting the state of thus formed image and controlling the image formation according to thus detected state.

The foregoing and still other objects of the present invention will be clarified in detail from the following description of the preferred embodiments.

DESCRIPTION OF THE PREFERRED EMBODIMENTS

The present invention will be disclosed in detail by the following description of the preferred embodiment to be taken in conjunction with the attached drawings.

Figure 1:
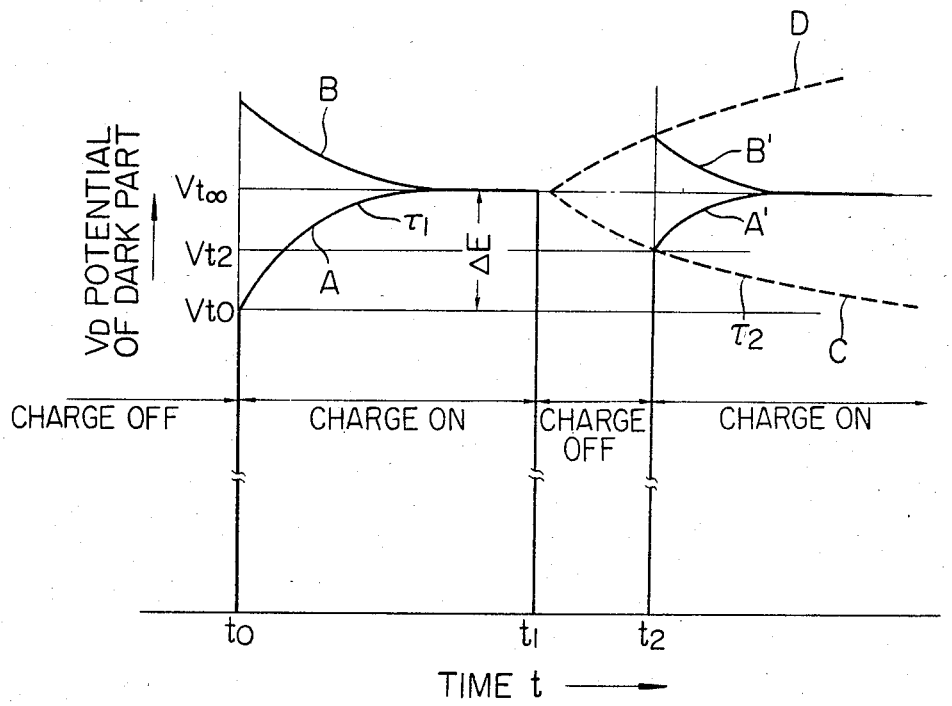
FIG. 1 is a chart showing the initial fluctuation in the charging characteristic.
Figure 2:
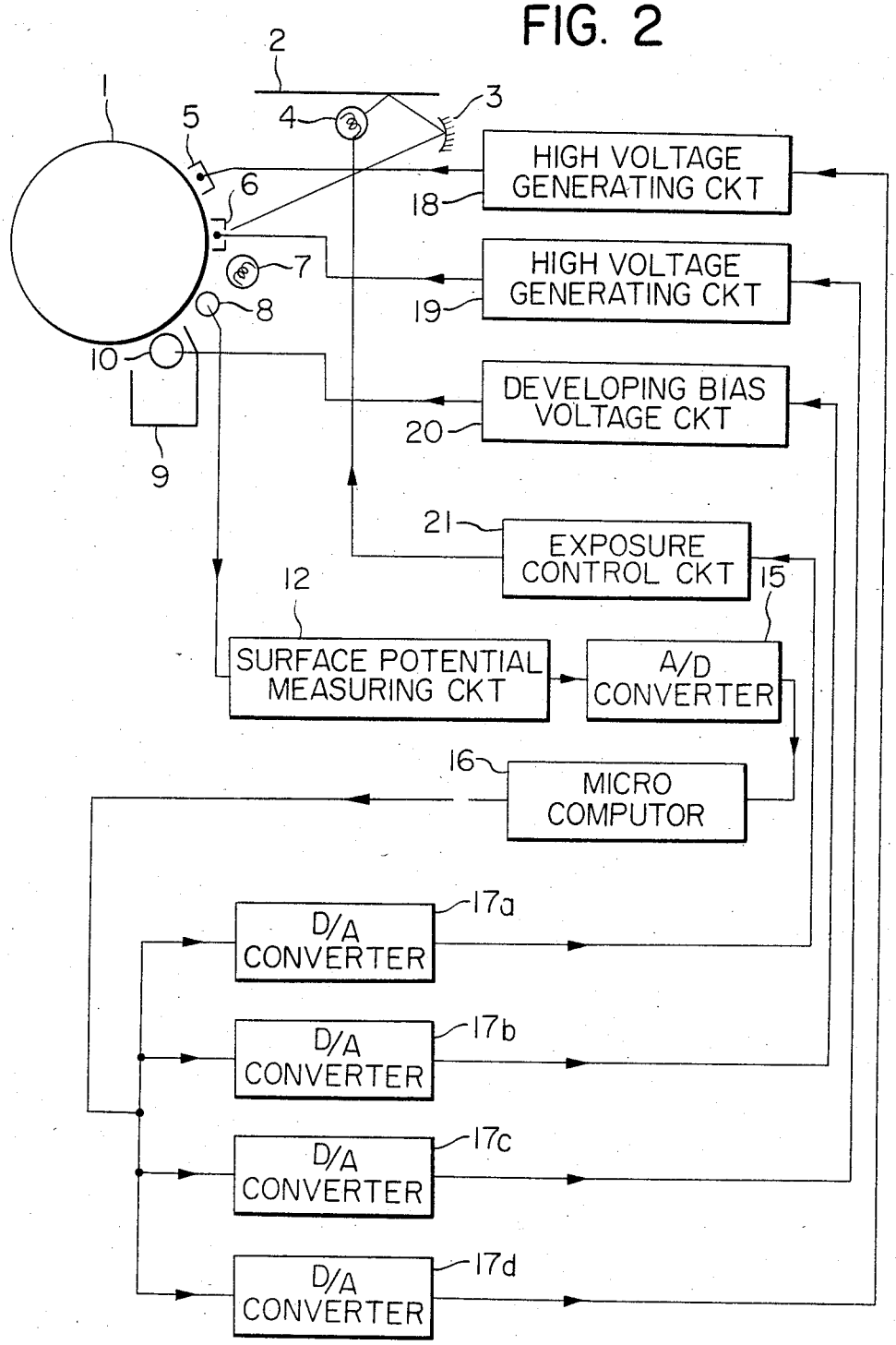
FIG. 2 is a block diagram showing an apparatus embodying the present invention.

FIG. 2 schematically shows an image recording apparatus, for example an electrophotographic copier, employing the image recording control of the present invention, wherein a photosensitive drum 1 has a three-layered structure consisting of an insulating layer, a photoconductive layer and a conductive layer in the order from the external periphery thereof. Close to said drum is provided a primary charger 5 for charging the entire surface of said drum 1. Adjacent to said primary charger 5 and along the rotating direction of said drum 1 there are provided a secondary charger or charge eliminater 6, and a flush exposure lamp 7. An original document 2 placed on a platen is illuminated by an exposure light source 4 such as a halogen lamp, and the reflected light is focused through an optical system 3 on said drum 1 in the vicinity of said secondary charger 6, which eliminates the charge on the drum according to the amount of exposure, thereby forming an electrostatic latent image of the original on said drum 1. Said latent image is further exposed entirely to the light of said flush exposure lamp 7, thereby forming an electrostatic latent image with improved tonal rendition. Thereafter said latent image is developed with toner by a developing roller 10 in a developing station 9 according to the known jumping development process.

In the vicinity of said photosensitive drum 1 and between the flush exposure lamp 7 and the developing station 9 there is provided a surface potential sensor 8, which measures the surface potential of the drum and transmits the measured result to a surface potential measuring circuit 12. The output signal from said circuit 12 is converted in an A/D converter 15 and is supplied to a microcomputer 16 for data processing to be explained later. Said microcomputer 16 can be composed of a known one-chip microcomputer incorporating read-only memory, random-access memory etc., for example a device known under a model number 8049 supplied by Intel Corp. The output signals after said data processing are converted into analog signals by D/A converters 17*a*–17*d* and supplied to high-voltage generating circuits 18, 19, a developing bias circuit 20 and an exposure control circuit 21 to respectively control the high voltages supplied to the primary and secondary chargers, developing bias and voltage supplied to the halogen lamp.

In such apparatus, a light potential $V_{SL}$ corresponding to a strong light exposure and a dark potential $V_D$ corresponding to the absence of light exposure are formed on the photosensitive drum 1 by suitably lighting and extinguishing said exposure lamp 4 or an unrepresented blank exposure lamp. Said potentials are detected by the potential sensor 8, then converted to determined levels by the measuring circuit 12, further converted into digital signals by the A/D converter 15 and stored in the microcomputer 16 in response to a timing signal supplied from an unrepresented sequence controller. Thus stored values are utilized for controlling the primary and secondary currents $I_1$, $I_2$ in the primary and secondary chargers 5, 6 according to the following equations:

$$\Delta I_1=\alpha_1\Delta V_D+\alpha_2\Delta V_{SL} \quad (1)$$

$$\Delta I_2=\beta_1\Delta V_D+\beta_2\Delta V_{SL} \quad (2)$$

wherein $\Delta I_1$, $\Delta I_2$ are the amounts of variation, $\Delta V_D$, $\Delta V_{SL}$ are the aberrations from target values, and $\alpha_1$, $\alpha_2$, $\beta_1$, $\beta_2$ are control factors.

Subsequent to such charging control, a light potential $V_L$ is formed by a standard exposure, then converted in a similar manner and processed in the microcomputer 16 according to the following equation:

$$\Delta V_{HL}=\gamma_1\Delta V_L \quad (3)$$

wherein $\Delta V_L$ is the aberration from the target and $\gamma_1$ is a constant. The output signal is supplied through the D/A converter 17*a* to the exposure control circuit 21 for controlling the lighting voltage $V_{HL}$ of the halogen lamp for original exposure.

Subsequent to said exposure control a light potential $V'_L$ is formed with a standard exposure and processed in the same manner to calculate:

$$V_{DB}=V'_L+V_0 \quad (4)$$

wherein $V_0$ is a constant. The result of said calculation is supplied through the D/A converter 17*b* to the developing bias circuit 20 to control the developing bias voltage $V_{DB}$.

The above-mentioned controls are conducted at a determined timing prior to the image forming cycle, and are capable of completely compensating the slow change in the characteristic of the photosensitive drum caused by deterioration or environmental change.

Figure 3:
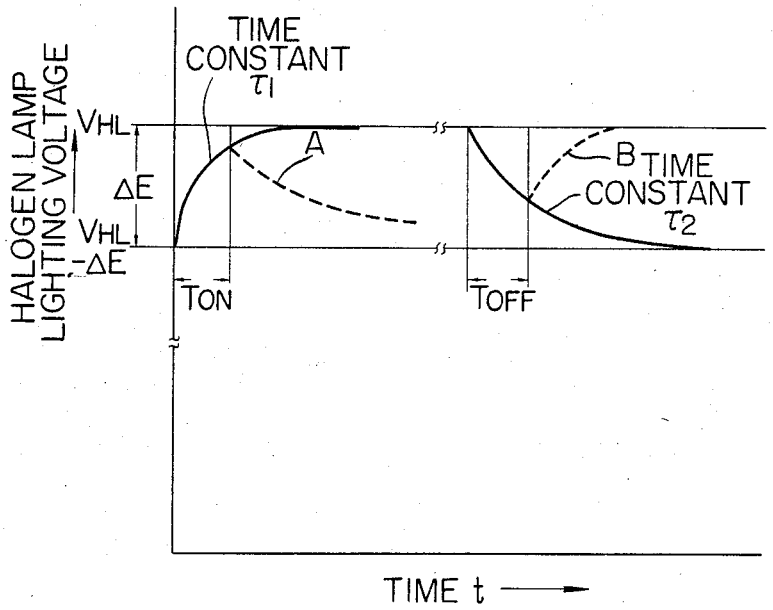
FIG. 3 is a chart showing a method for correcting the lighting voltage of a halogen lamp.

Subsequently, in response to a timing signal supplied from an unrepresented sequence controller, the microcomputer 16 measures the charging hysteresis, i.e. the charging-off period $T_{OFF}$ and the charging-on period $T_{ON}$ to control the voltage $V_{HL}$ supplied to the halogen lamp for illuminating the original in the following manner. During the charging step said voltage is corrected according to the following equation:

$$V'_{HL(ON)}=\Delta E(1-e^{-t/\tau 1})+(V_{HL}-\Delta E) \quad (5)$$

wherein $\Delta E$ indicates the correction according to the charging hysteresis, as graphically shown at the left-hand side in FIG. 3. Also when the charging step is terminated, said voltage $V_{HL}$ is reduced to zero by the sequence controller and is thereafter controlled according to the following equation, as graphically shown in the right-hand side in FIG. 3:

$$V'_{HL(OFF)}=\Delta E\cdot e^{-t/\tau 2}+(V_{HL}-\Delta E) \quad (6)$$

$\tau_1$ and $\tau_2$ in the equations (5) and (6) are time constants respectively in the order of 20 to 30 seconds and about 5 minutes.

Also, in case the charging step is initiated before the charging off period $T_{OFF}$ reaches saturation as shown by a curve B in FIG. 3, the control is conducted according to the equation (5) except that ΔE therein is replaced by:

$$\Delta E \cdot e^{-TOFF/\tau 2} \quad (7)$$

Also, in case the charging step is terminated before the charging on period $T_{ON}$ reaches saturation, the control is conducted according to the equation (6) except that ΔE therein is replaced by:

$$\Delta E \cdot (1-e^{-TON/\tau 1}) \quad (8)$$

The constants ΔE, $\tau_1$ and $\tau_2$ include fluctuations inherent to each photosensitive drum and variations caused by environmental change. Consequently, prior to the control of the halogen lamp lighting voltage according to the equations (5) to (8), said constants are calculated in a control rotation of the drum to be conducted during the warming-up period of the apparatus, warming-up period of the fixing heater, preliminary rotation of the photosensitive drum for electrostatic cleaning prior to the copying operation or during control of the latent image potential according to the aforementioned equations (1) to (4). In the present embodiment the charging-on period and charging-off period are measured by a timer provided in the microcomputer.

Figure 5:
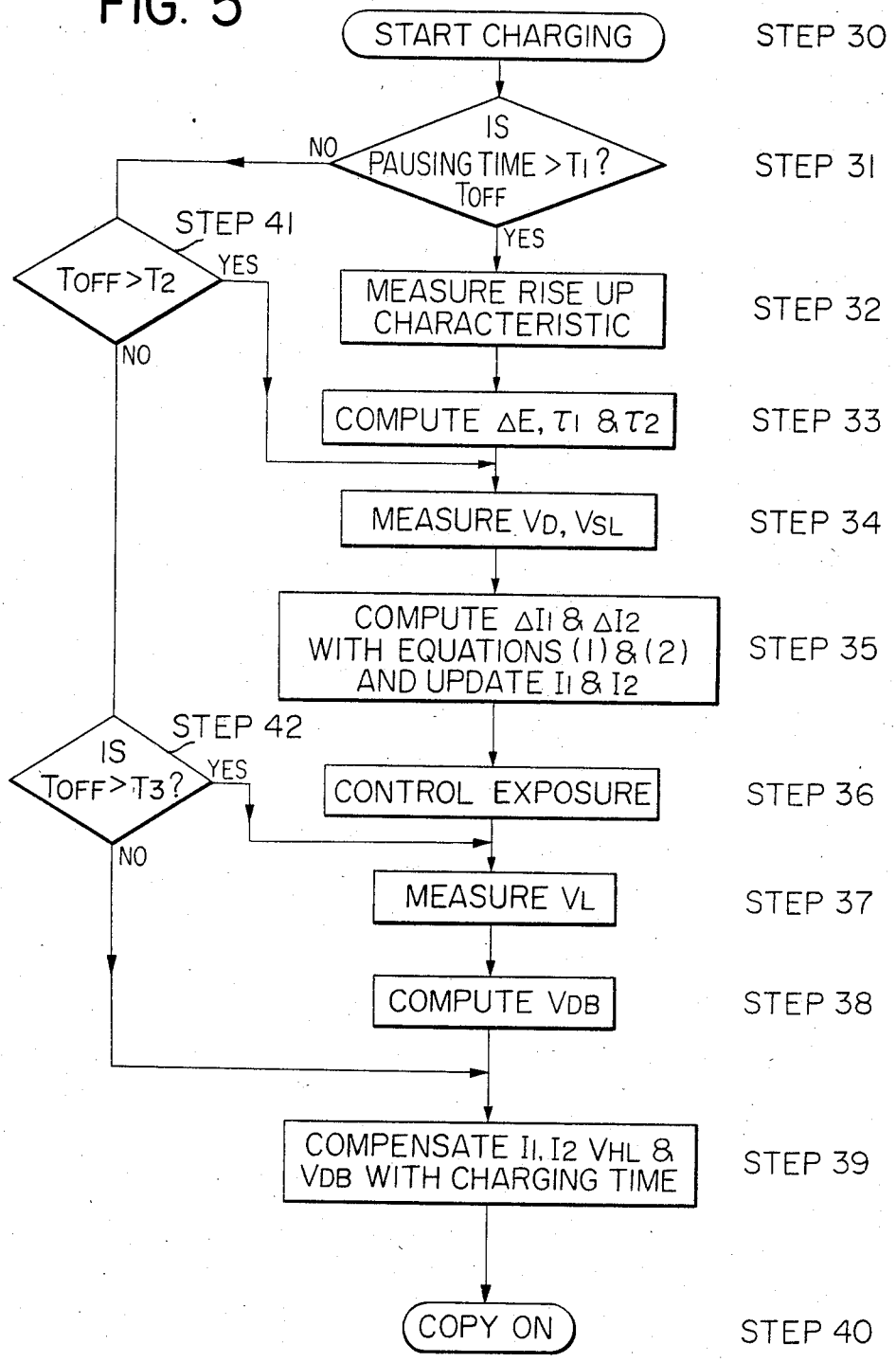
FIG. 5 is a control flow chart of an embodiment of the present invention.

In the present embodiment, in case the pause between the image forming cycles exceeds 30 minutes, the dark potential is measured during said preliminary rotation or during control rotation for controlling the potential of the latent image, in order to determine the change in charging immediately after the start of the charging step thereby obtaining ΔE, $\tau_1$ and $\tau_2$. As shown in the control flow chart in FIG. 5, in case the copy start button is actuated at t=0 (Step 30) after a pause longer than 30 minutes (T1), the drum rotations for charging and exposure control according to the equations (1) to (4) are effected before the image forming cycle. Subsequently, it is identified if the pause $T_{OFF}$ is longer than $T_1$, and, if so, the program proceeds to the Step 32 for the measurement of the initial characteristic.

Figure 4:
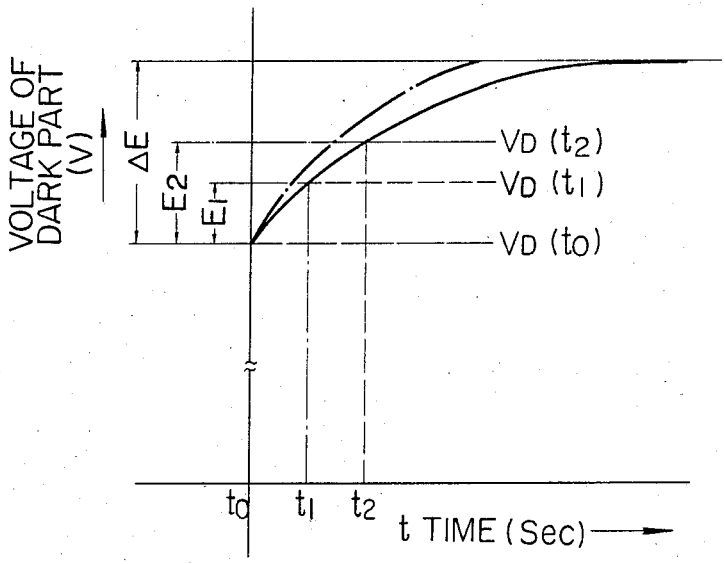
FIG. 4 is a chart showing the change in the dark potential at the start of charging.

In said measurement of the initial characteristic the exposure lamp 4 or the unrepresented blank exposure lamp is extinguished immediately after the start of charging ($t_0$) and at determined times ($t_1$ and $t_2$) to determine the dark potentials $V_D(t_0)$, $V_D(t_1)$ and $V_D(t_2)$, from which the microcomputer 16 calculates ΔE, $\tau_1$ and $\tau_2$ (Step 33) according to the following equations:

$$E_1=\Delta E(1-e^{-t1/\tau 1}) \quad (9)$$

$$E_2=\Delta E(1-e^{-t2/\tau 1}) \quad (10)$$

wherein:

$$E_1=V_D(t_1)-V_D(t_0) \text{ and}$$

$$E_2=V_D(t_2)-V_D(t_1)$$

and $\tau_1$ is the time constant of the charging recovery characteristic. By substituting e in the equations (9) and (10) with:

$$e^x \approx 1+(x/1!)+(x^2/2!)$$

there are obtained the following approximations represented by a chain line in FIG. 4:

$$E_1 \approx \Delta E\{-(t_1/r_1)-\tfrac{1}{2}(t_1/r_1)^2\} \quad (11)$$

$$E_2 \approx \Delta E\{-(t_2/r_1)-\tfrac{1}{2}(t_2/r_1)^2\} \quad (12)$$

From (11) and (12):

$$E_1\{(t_2/r_1)+\tfrac{1}{2}(t_2/r_1)^2\}=E_2\{(t_1/r_1)+\tfrac{1}{2}(t_1/r_1)^2\}$$

from which $\tau_1$ is determined by:

$$r_1=\frac{-E_1t_2^2+E_2t_1^2}{2(E_1t_2-E_1t_1)}$$

Assuming $t_2=2t_1$:

$$r_1=\frac{(-4E_1+E_2)}{2(2E_1-E_2)}\cdot t_1$$

By writing $k_1=(-4E_1+E_2)/2(2E_1-E_2)$, there is obtained:

$$\tau_1=k_1t_1 \quad (13)$$

$$\Delta E=E_1k_1(1-\tfrac{1}{2}k_1) \quad (14)$$

On the other hand the time constant $\tau_2$ representing the charge decay after the termination of charging is given by:

$$\tau_2=k_2\cdot\tau_1 \quad (15)$$

wherein $k_2$ is a constant not influenced by the fluctuation between different drums or by the environmental change and is obtained as a mean value of measurements on plural drums.

In this manner ΔE, $\tau_1$ and $\tau_2$ are calculated in the Step 33 and are utilized in the aforementioned exposure control in response to the charging hysteresis according to the equations (5) to (8). Subsequent to said calculation the aforementioned control according to the equations (1) to (4) to effected in the Steps 34 to 38.

Then $I_1$, $I_2$, $V_{HL}$ and $V_{DB}$ determined before are respectively corrected in the Step 39 by:

$$I_1k_1\Delta E(1-e^{-t/r1}) \quad (16)$$

$$I_2k_2\Delta E(1-e^{-t/r1}) \quad (17)$$

$$V_{HL}K_3\Delta E(1-e^{-t/r1}) \quad (18)$$

$$V_{DB}k_4\Delta E(1-e^{-t/r1}) \quad (19)$$

wherein $k_1$ to $k_4$ are constants, and the copying operation is initiated in the Step 40.

On the other hand, in case the pause $T_{OFF}$ is shorter than $T_1$, the Step 41 is executed to identify if $T_{OFF}$ is longer than $T_2$. Said period $T_2$ is so selected as to satisfy a condition $T_2>>\tau_1$ in case a condition $T_2>>\tau_2$ exists but the heater requires a considerable period for reaching a fixing state. Thus, if $T_2<T_{OFF}<T_1$, the program proceeds to the Step 34 without the measurement of the initial characteristic. In the present embodiment said period $T_2$ is selected as 1 minute.

In case the pause is shorter than said period Step 42 is executed to identify if the pause is longer than $T_3$. Said period $T_3$ is so selected as not to satisfy the conditions $T_3 >> \tau_2$, $T_3 >> \tau_1$ but as to allow drum rotations for one or two turns for controlling the latent image formation and the exposure according to the equations (16) and (17), and the program proceeds to Step 37 when a condition $T_3 < T_{OFF} < T_2$ is satisfied. In the present embodiment the period $T_3$ is selected equal to 10 seconds.

In case $T_{OFF} < T_3$, Step 39 is executed to perform the compensation for initial fluctuation according to the equations (16) to (19).

The control according to the equations (1) to (4) in response to the aforementioned detection of the latent image potential is not conducted in real-time but is delayed by the distance from the control means to the potential sensor 8. Also, said control cannot be executed frequently since the lamp utilized for forming the light and dark image areas requires considerably long starting and extinguishing time. For this reason the control of the latent image potential is executed in case $T_{OFF} >> \tau_2$ and when the charging time satisfies the condition $T_{ON} >> \tau_1$ after sufficient preliminary rotation during the warm-up time of the fixing heater. The optimum control value of the latent image potential is stored in the microcomputer in order to control the image formation.

Also the fluctuation in the charging characteristic resulting from charging hysteresis, giving rise to a density difference between the first and second copies in every copying operation, is compensated by correcting, according to the equations (5) to (8), the optimum image conditions obtained by the latent image potential control.

Figure 6:
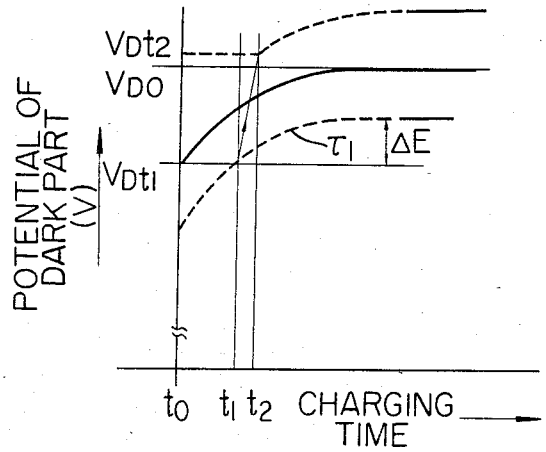
FIG. 6 is a chart showing the aberration of the dark potential from a target value immediately after the start of charging.

In the above-mentioned image recording control, the image potential will become aberrated from the target value if the control for the image potential is conducted during the initial period of the charging step when said fluctuation is significant. More specifically, as shown in FIG. 6, the dark potential $V_D$ can be brought to $V_{Dt2}$ approximately equal to the target value $V_{D0}$ by starting the charging at $t_0$, measuring the dark current $V_{Dt1}$ at $t_1$ and executing the compensation at $t_2$ for the primary and secondary currents according to the equations (1) and (2). However the potential will become aberrated from said target value afterwards, when the initial fluctuation is terminated. Such inconvenience in the image potential control can be resolved by a method explained in the following in relation to FIG. 7. At first $\Delta E$ is determined according to the aforementioned equations (13) to (15) by measuring $V_D$ at $t_0$, $t_1$ and $t_2$. Then $V_D(T_\infty)$ is calculated and introduced into the equations (1) and (2) in place of $V_D(t_2)$, and the obtained control values for $I_1$, $I_2$ are utilized for compensation at $t_3$. In this manner the potential $V_D$ arrives at the value $V_{Dt3}$ on the target curve.

Figure 7:
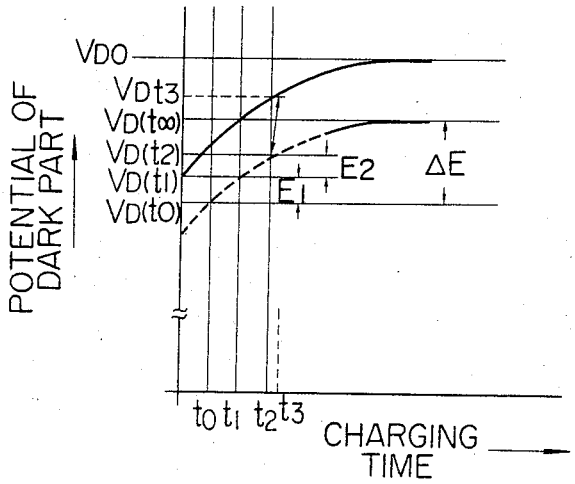
FIG. 7 is a chart showing a method for compensating said aberration.
Figure 8:
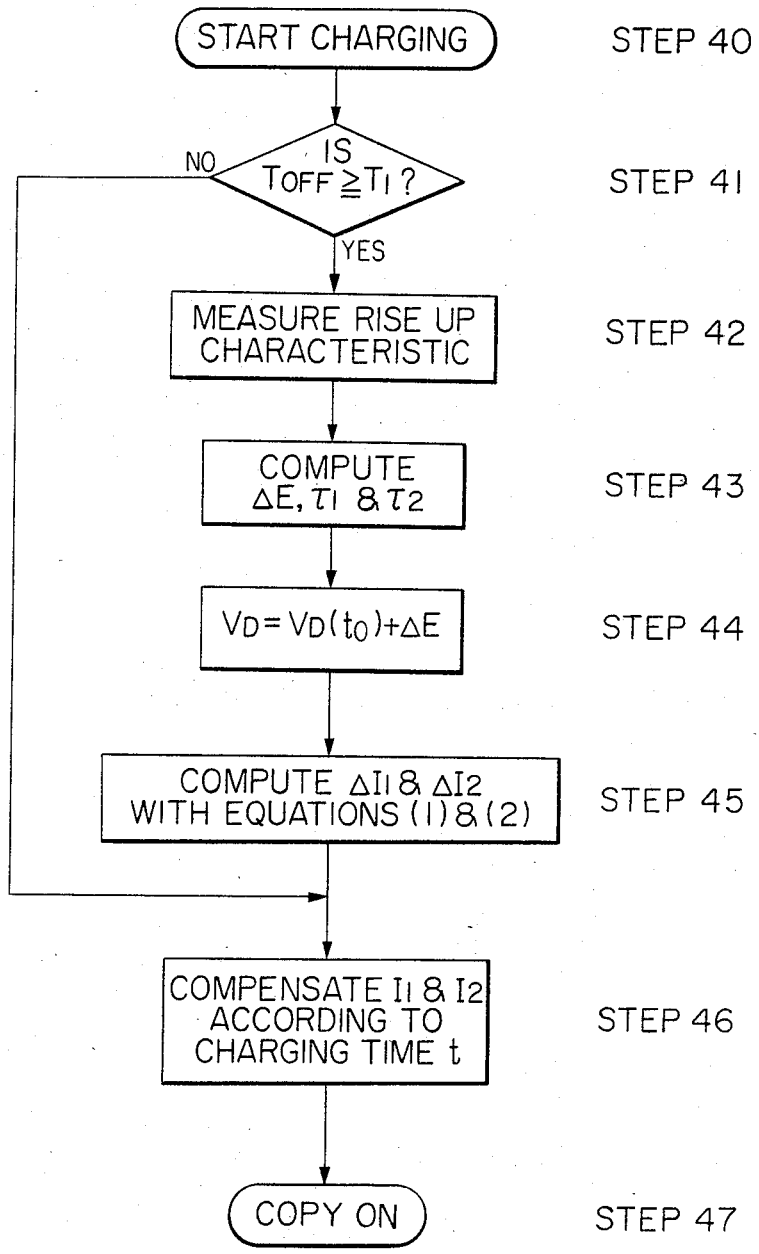
FIG. 8 is a control flow chart for said compensation shown in FIG. 7.

FIG. 8 shows a control flow chart showing an example of such control. In FIG. 8 the Steps 40 to 43 are the same as Steps 30 to 33 in FIG. 6 and are therefore omitted from the following explanation. The control steps shown in FIG. 7 are executed in the Steps 44 and 45.

Subsequently, Step 46 is executed to correct the currents $I_1$ and $I_2$ according to:

$$I_1 k_1 \Delta E(1-e^{-t/\tau_1}) \text{ and}$$

$$I_2 k_2 \Delta E(1-e^{-t/\tau_1})$$

according to the charging hysteresis, wherein $k_1$ and $k_2$ are constants. The exposure and developing conditions are also corrected according to the charging hysteresis and the copying operation is initiated with such corrected conditions in Step 47.

In case the length of pause is shorter than $T_1$ in the flow chart shown in FIG. 8, the corrections are made with the preceding values without repeated measurement of the initial characteristics.

In the foregoing embodiment the recording conditions including the charging exposure and developing conditions are controlled by the latent image potential measured as a parameter indicating the surface state and the exposure condition is further corrected by the charging hysteresis, but it is also possible to omit the control on some of the recording conditions, to apply the correction according to the charging hysteresis to other condition or conditions. Furthermore it is possible to achieve similar control according to the density of the developed image in place of the latent image potential.

As explained in the foregoing, the apparatus of the present invention comprises means for measuring the charging hysteresis of the recording member, means for correcting the image recording conditions according to said charging hysteresis and means for measuring and memorizing the initial fluctuation in the charging characteristic of the recording member in the initial period of the charging step in order to modify the correction of image recording conditions determined by the measurement of surface potential in response to the memorized fluctuation and further to modify said correction according to the charging hysteresis.

In this manner the apparatus of the present invention provides the advantages of:

(1) achieving complete compensation for a rapid fluctuation in the characteristic of the photosensitive drum immediately after the start of the charging step and for a slow change in said characcteristic caused by environmental change or deterioration;

(2) avoiding an external timer circuit for measuring the charging hysteresis or a mixing circuit for the result of said measurement and the control data determined according to the latent image potential, since the charging hysteresis is measured inside the microcomputer itself;

(3) achieving compensation for the initial fluctuation caused by an environmental change, particularly by humidity change without direct measurement of the humidity; and (4) avoiding the necessity of adjustment of $\Delta E$ and $\tau_1$ at each drum replacement.

Furthermore, the control factors $\alpha_1$, $\alpha_2$, $\beta_1$ and $\beta_2$ in the foregoing equations (1) and (2) can be made variable according to certain conditions, for example according to the length of pause between charging steps or to the fluctuation between different photosensitive drums, as will be explained in the following embodiment.

Figure 9A:
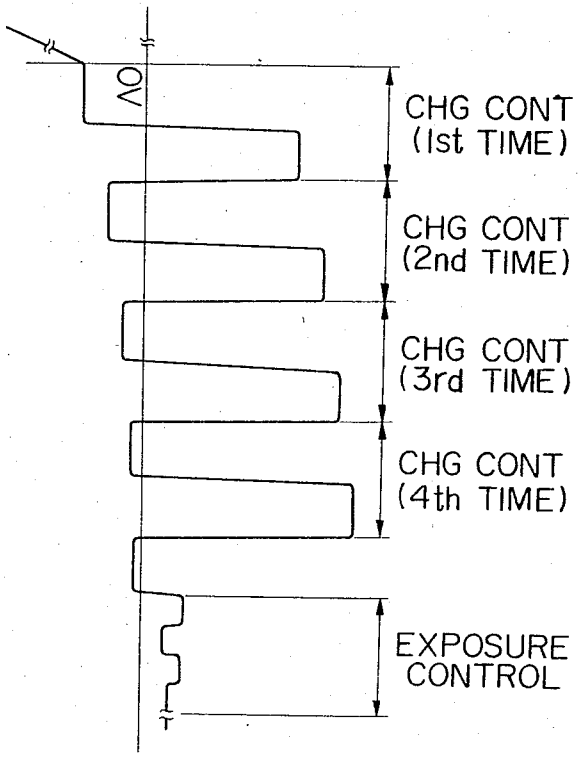
FIG. 9A is a chart showing the control procedure for charging and exposure.

In such case, as shown in FIG. 9A, the charging control according to the equations (1) and (2) is repeated for a number of times determined for example, by a pause. For example, it is repeated four times at the start of power supply. In the first charging control the primary and secondary currents $I_1$, $I_2$ are changed in three phases to measure the light potential $V_{SL}$ and dark potential $V_D$. Said control factors $\alpha_1$, $\alpha_2$, $\beta_1$ and $\beta_2$ are calculated from the charging characteristic of the photosensitive drum thus determined.

Figure 9B:
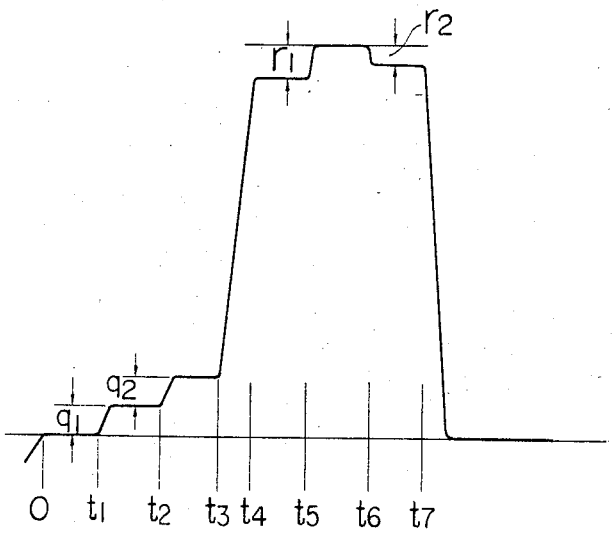
FIG. 9B is a chart showing the procedure of forming light and dark potentials in order to determine the control factor.

More specifically, as shown in FIG. 9B, the exposure lamp 4 or an unrepresented blank exposure lamp is turned on at a high intensity during a period 0–$t_3$ to determine the light potential $V_{SL}$, and said lamp is extinguished during a period $t_3$–$t_4$ to determine the dark potential $V_D$.

The primary and secondary currents are adjusted to $I_{10}$, $I_{20}$, which are determined at the production of the apparatus or at the preceding control, during periods 0–$t_1$ and $t_4$–$t_5$, then to $I_{10}+A$ and $I_{20}+B$ during periods $t_1$–$t_2$ and $t_5$–$t_6$, and to $(I_{10}+A)+C$ and $(I_{20}+B)+D$ during periods $t_2$–$t_3$ and $t_6$–$t_7$ wherein A, B, C and D are constants. The light potentials $V_{SL}(0-t_1)=x_1$, $V_{SL}(t_1-t_2)=x_2$, $V_{SL}(t_3-t_4)$ and the dark potentials $V_D(t_4-t_5)$, $V_D(t_5-t_6)=y_2$, $V_D(t_6-t_7)=y_3$ are stored in the microcomputer 16.

By writing $r_1=y_2-y_1$, $r_2=y_3+y_2$, $q_1=x_2-x_1$ and $q_2=x_3-x_2$, the equations (1) and (2) can be rewritten as: $A=\alpha_1 r_1+\alpha_2 q_1$, $B=\beta_1 r_1+\beta_2 q_1$, $C=\alpha_1 r_2+\alpha_2 q_2$ and $D=\beta_1 r_2+\beta_2 q_2$, so that $\alpha_1=(q_1C-q_2A)/(r_2q_1-q_2r_1)$, $\alpha_2=(Ar_2-r_1C)/(r_2q_1-q_2r_1)$, $\beta_1=(q_1D-q_2B)/(r_2q_1-q_2r_1)$, and $\beta_2=(Br_2-r_1D)/(r_2q_1-q_2r_1)$.

The control factors $\alpha_1$, $\alpha_2$, $\beta_1$, $\beta_2$, measured values $x_1$, $y_1$ and initial values $I_{10}$, $I_{20}$ are introduced into the equations (1) and (2) to obtain second control values $I_1$ and $I_2$.

The determination of factors in the foregoing embodiment is conducted in the first charging control, but it can also be conducted in the following manner:

a. The first control is executed with the control factors predetermined at the production of the apparatus, and the factors are calculated in the second control or thereafter;

b. The control is repeated three times with determined control factors to determine the control factors;

c. Correction is made in case the control factors determined in the method b are larger than those used before. As an alternative, it is also possible to calculate the control factors a number of times and use the mean value thereof as the control factors thereafter. It is furthermore possible to indicate the necessity of drum replacement in case the control factors thus determined become smaller than predetermined values.

Furthermore, it is possible to determine the control factors by changing the exposure condition in combination with or in place of the charging condition.

As explained in the foregoing, since the control is always conducted with the control factors matching the charging characteristic of the photosensitive drum, the apparatus of the present invention allows the target potential to be reached with a reduced number of controls. Also the higher precision of control allows expansion of the tolerance for the fluctuation of performance between different photosensitive drums or for time-dependent deterioration of the drum, thus significantly extending the service life of the photosensitive drum. Furthermore the waste time for the calculation of control factors is avoided since it can be simultaneously conducted with the control itself.

Furthermore, the aforementioned control method of calculating the control factors in the control equations can also be formulated in such a manner that the image forming conditions determined by said control equations are corrected according to the charging hysteresis and the initial fluctuation in the charging characteristic.

Figure 10:
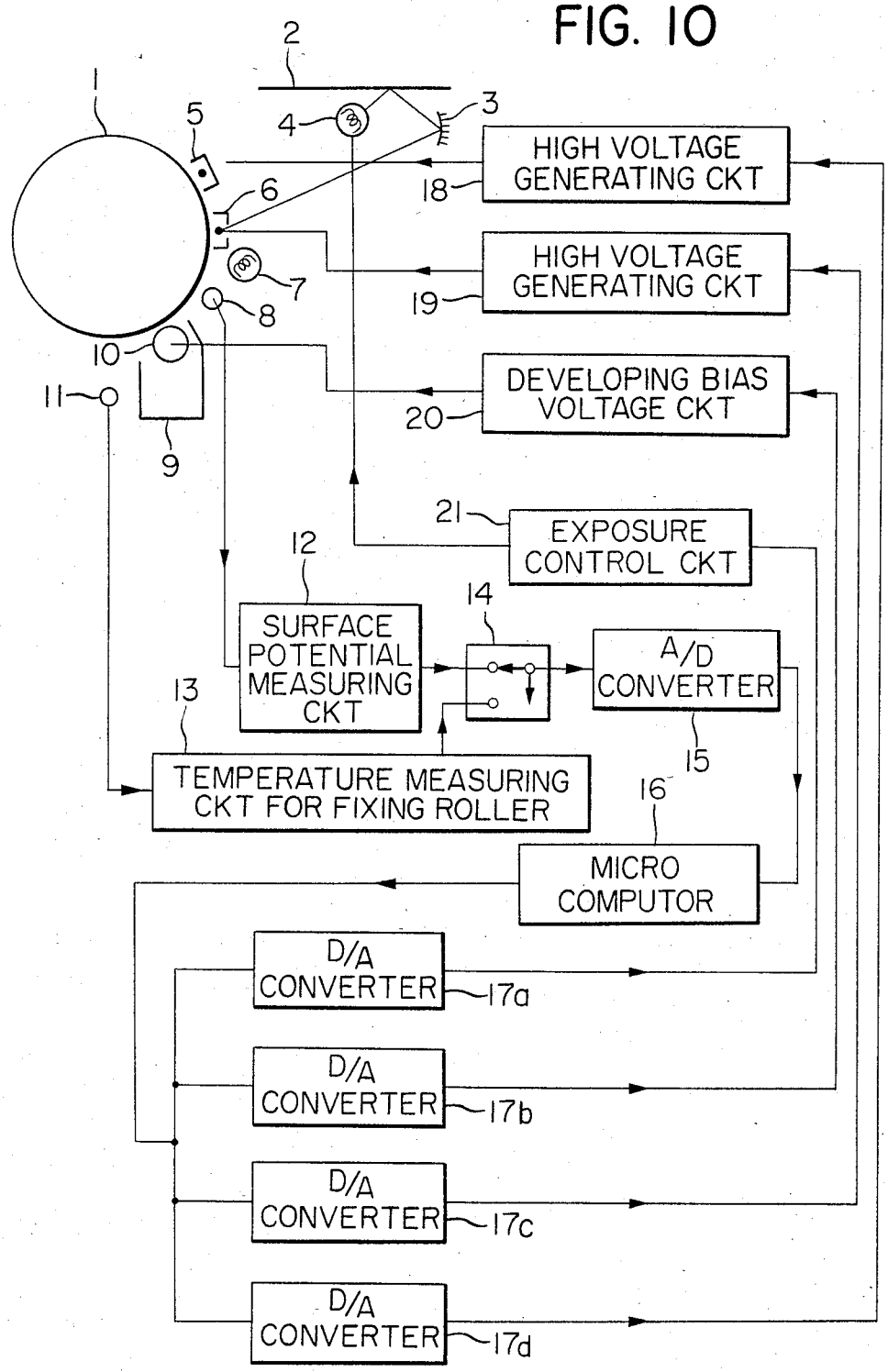
FIG. 10 is a block diagram showing another embodiment of the present invention.

An embodiment employing such method is shown in FIG. 10, wherein the components are the same as those in FIG. 2 are represented by same numbers.

In this embodiment a fixing temperature sensor 11 is positioned under the photosensitive drum 1. The signals from the surface potential sensor 8 and the temperature sensor 11 are respectively supplied to a surface potential measuring circuit 12 and a fixing temperature measuring circuit 13, of which output signals are supplied through an analog switch 14, converted into digital signals by an A/D converter 15 and introduced into the microcomputer 16 for data processing reflecting the surface potential and the fixing temperature as will be explained in the following.

Figure 11B:
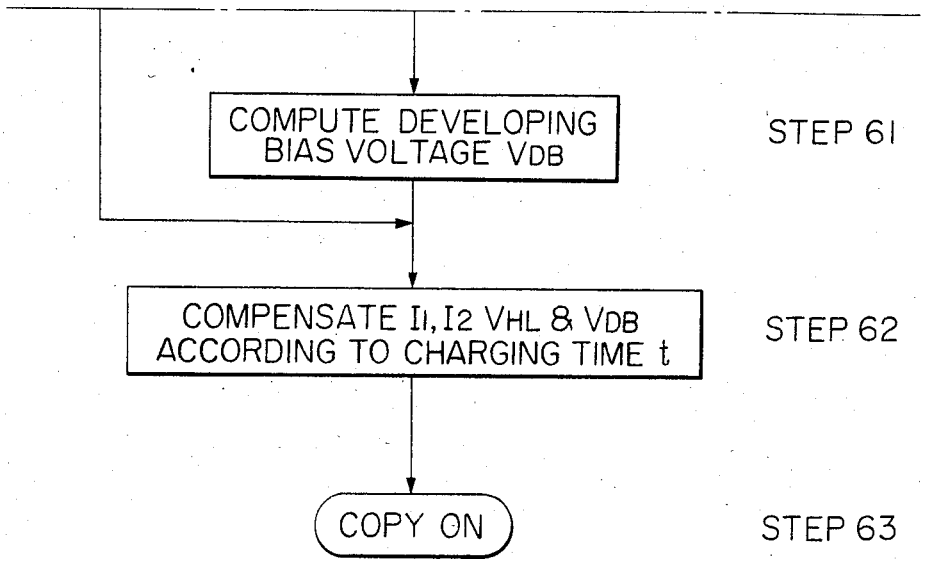
FIGS. 11A and 11B show a control flow chart therefor.
Figure 11:
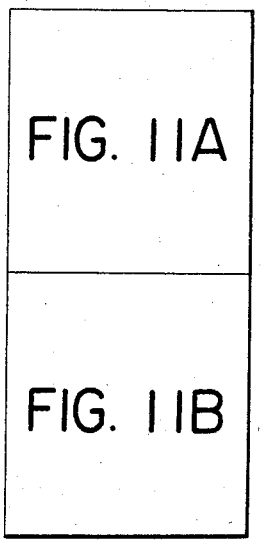
Figure 11A:
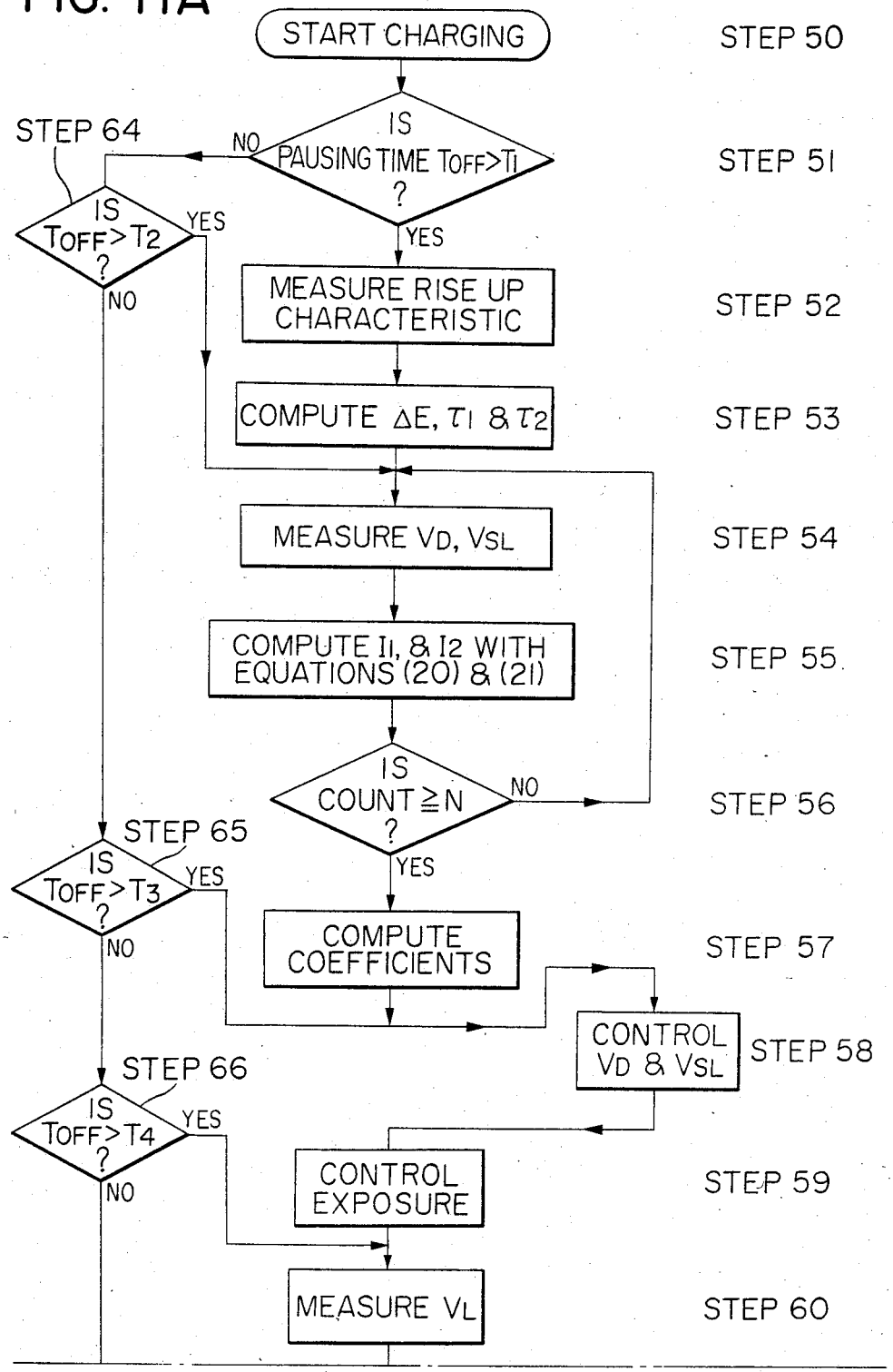

Now reference is made to a corresponding control flow chart shown in FIG. 11. The charging step by the chargers 5, 6 is initiated by a Step 50. At the start of said charging step the temperature of an unrepresented fixing roller is detected by the temperature sensor 11, temperature measuring circuit 13 and analog switch 14, and the obtained signal is supplied through the A/D converter 15 to the microcomputer 16 for calculating the length of pause $T_{OFF}$ after the preceding charging step from the temperature characteristic. In case the fixing roller requires a considerable period for reaching the fixing temperature, a period $T_1$ is so selected to satisfy a condition $T_1>>\tau_2$, and Step 51 identifies if $T_{OFF}<T_1$. In the present embodiment said period $T_1$ is for example selected as 30 minutes. In case the result of said identification is affirmative indicating a long pause with a significant initial fluctuation, Step 52 is executed to measure the initial characteristic. The Steps 52 and 53 are the same as the Steps 32 and 33 shown in FIG. 6.

Subsequently Steps 54 to 56 are executed to repeat the charging control number of times as illustrated in FIG. 9A. Said charging control is conducted by measuring, with the surface potential sensor 8, the light potential $V_{SL}$ formed by lighting the exposure lamp 4 with a high intensity and the dark potential $V_D$ formed by extinguishing said lamp for calculating the charging currents according to the following equations:

$$I_1=\alpha'_1(V_D-C_1)+\alpha'_2(V_{SL}-C_2)+I_{10} \quad (20)$$

$$I_2=\beta'_1(V_D-C_1)+\beta'_2(V_{SL}-C_2)+I_{20} \quad (21)$$

wherein $\alpha'_1$, $\alpha'_2$, $\beta'_1$, $\beta'_2$ are constants programmed in the microcomputer 16 at the production of the apparatus, $C_1$, $C_2$ are target values of $V_D$ and $V_{SL}$, and $I_{10}$, $I_{20}$ are initial or previous control values.

Said charging control is terminated after a period sufficient for absorbing the initial fluctuation, namely a period satisfying the condition $T_{ON}>>\tau_1$.

After $V_D$ and $V_{SL}$ become sufficiently close to the target values, Step 57 is executed to calculate the control factors in the equations (20) and (21). Said calculation is conducted by measuring the light potential $V_{SL}$ formed by an exposure with a high intensity during a period from 0 to $t_3$ and the dark potential $V_D$ formed by extinguishing the exposure lamp during a period from $t_3$ to $t_7$. Also the primary and secondary currents, $I_1$, $I_2$ are adjusted to $I_{10}$, $I_{20}$ which are calculated in the Step 56 in FIG. 11 during periods 0–$t_1$ and $t_4$–$t_5$, then to $I_{10}+A$, $I_{20}+B$ during periods $t_1$–$t_2$ and $t_5$–$t_6$, and to $(I_{10}+A)+C$, $(I_{20}+B)+C$ during periods $t_2$–$t_3$ and $t_6$–$t_7$, wherein A, B, C and D are constants. The light potentials $V_{SL}(0-t_1)=x_1$, $V_{SL}(t_1-t_2)=x_2$, $V_{SL}(t_2-t_3)=x_3$ and the dark potentials $V_D(t_4-t_5)=y_1$, $V_D(t_5-t_6)=y_2$, $V_D(t_6-t_7)=y_3$ thus formed during the period 0 to $t_7$ are stored in the microcomputer 16.

By writing $r_1=y_2-y_1$, $r_2=y_3+y_2$, $q_1=x_2-x_1$ and $q_2=x_3-x_2$, the equation (8) can be rewritten as $A=\alpha_1 r_1+\alpha_2 q_1$, $B=\beta_1 r_1+\beta_2 q_1$, $C=\alpha_1 r_2+\alpha_2 q_2$ and $D=\beta_1 r_2+\beta_2 q_2$, so that $\alpha_1=(q_1C-q_2A)/(r_2q_1-q_2r_1)$, $\alpha_2=(Ar_2-r_1C)/(r_2q_1-q_2r_1)$, $\beta_1=(q_1D-q_2B)/(r_2q_1-q_2r_1)$, $\beta_2=(Br_2-r_1D)/(r_2q_1-q_2r_1)$.

The values $\alpha_1$, $\alpha_2$, $\beta_1$ and $\beta_2$ thus obtained are stored in the memory of the microcomputer 16 instead of the aforementioned values $\alpha'_1$, $\alpha'_2$, $\beta'_1$ and $\beta'_2$.

Then Step 58 is executed to measure $V_D$ and $V_{SL}$, and to determine $I_1$ and $I_2$ according to the equations (20) and (21) with newly determined control factors.

Then the exposure lamp 4 is adjusted to the standard intensity for measuring the light potential $V_L$ in the Step 59, and the exposure control is conducted by correcting the lighting voltage $V_{HL}$ of the exposure lamp according to an equation $\Delta V_{HL}=\gamma_1\Delta V_L$ wherein $\Delta V_L$ is the aberration in $V_L$. After said exposure control Step 60 is executed to again measure $V_L$, and Step 61 calculates the developing bias voltage $V_{DE}$ according to an equation $V_{DE}=V_L+C_3$ wherein $C_3$ is a constant voltage.

In the following Step 62 the values $I_1$, $I_2$, $V_{HL}$ and $V_{DB}$ already obtained in the foregoing procedure are respectively corrected by the following equations:

$$I_1 + C_4\Delta E\left(1 - e^{-\frac{TOFF}{\tau 2}}\right) e^{-\frac{t}{\tau 1}} \quad (22)$$

$$I_2 + C_3\Delta E\left(1 - e^{-\frac{TOFF}{\tau 2}}\right) e^{-\frac{t}{\tau 1}} \quad (23)$$

$$V_{HL} + C_6\Delta E\left(1 - e^{-\frac{TOFF}{\tau 2}}\right) e^{-\frac{t}{\tau 1}} \quad (24)$$

$$V_{DB} + C_7\Delta E\left(1 - e^{-\frac{TOFF}{\tau 2}}\right) e^{-\frac{t}{\tau 1}} \quad (25)$$

wherein $C_4$–$C_7$ are constants. Then in the following Step 63 the image forming cycle is initiated with the charging, exposure and developing bias determined by the above-mentioned equations (22) to (25) in response to the pause $T_{OFF}$ and the charging period t.

In case $T_{OFF}<T_1$, Step 64 is executed to identify if $T_{OFF}>T_2$, wherein the period $T_2$ is so determined as not to satisfy a condition $T_2>>\tau_2$ but is long enough for bringing the heater to the fixing condition, i.e. $T_2>>\tau_1$. Thus, in case $T_2<T_{OFF}<T_1$, the program proceeds to the Step 54 without the measurement of the initial characteristic. In the present embodiment the period $T_2$ is selected equal to 1 minute.

Also in case $T_{OFF}<T_2$, Step 65 is executed to identify if $T_{OFF}>T_3$, wherein the period $T_3$ is so selected as not to satisfy conditions $T_3>>\tau_2$ and $T_3>>\tau_1$ but is long enough to allow drum rotation for one or two turns for controlling the latent image potential and exposure according to the equations (20) and (21). In case $T_3<T_{OFF}<T_2$ the calculation of control factors are omitted. In the present embodiment said period $T_3$ is selected equal to 20 seconds.

In case $T_{OFF}<T_3$, Step 66 is executed to identify if a condition $T_{OFF}>T_4$ is satisfied, wherein the period $T_4$ is selected shorter than the period required for drum rotation for the control. In case $T_{OFF}<T_4$, executed is the correction for the initial fluctuation according to the equations (22) to (25). In the present embodiment the period $T_4$ is selected equal to 5 seconds.

In the foregoing procedure, the periods $T_1$ to $T_4$, in which the charging is interrupted, are detected by the measurement of the temperature of the fixing roller with the sensor 11 under the control of the analog switch 14.

As detailedly explained in the foregoing, in the apparatus of the present invention, the image forming conditions determined by the control factors matching the characteristic of the photosensitive drum are corrected according to the charging hysteresis and the initial fluctuation of the charging characteristic. It is therefore rendered possible to simultaneously compensate the change in the sensitivity immediately after the start of the charging step and the change in the sensitivity resulting from a change in the environmental conditions, and to further compensate slow changes in the characteristic resulting for example from time-dependent deterioration of the photosensitive drum. Such compensations are not affected by the fluctuations between different photosensitive drums or by the environmental changes, and thus enable the avoidance of cumbersome adjustments for the various control factors in the replacement of the photosensitive drum.

What we claim is:

1. An image forming apparatus comprising:

image forming means for forming an image on a recording medium;

measuring means for measuring a sensitivity characteristic of the recording medium prior to the image formation; and control means for detecting an image forming condition and controlling said image forming means to provide a proper image forming condition by means of performing a predetermined arithmetic processing for the detected value, said control means being adapted to determine a parameter involved in the arithmetical processing in accordance with the sensitivity characteristic measured by said measuring means.

2. An image forming apparatus according to claim 1, wherein said correcting means corrects the parameter in accordance with a rest time period of the image forming operation.

3. An image forming apparatus according to claim 2, wherein said correcting means corrects the parameter when said rest time period is greater than a predetermined value, and does not correct the parameter when said rest time period is less than the predetermined value.

4. An image forming apparatus according to claim 1, wherein said image forming means includes an exposure lamp for exposing an original, and said parameter pertains to a turn on voltage of said exposure lamp.

5. An image forming apparatus according to claim 1, wherein said image forming means includes a charger for charging said recording medium, and said parameter pertains to a charging current of said charger.

6. An image forming apparatus according to claim 1, wherein said image forming means includes a developer for developing a latent image formed on said recording medium, and said parameter pertains to a developing bias voltage to be applied to said developer.

7. An image forming apparatus according to claim 1, wherein said control means includes detecting means for detecting a surface condition of said recording medium, and wherein said control means controls said image forming means in accordance with the output of said detecting means.

8. An image forming apparatus according to claim 7, wherein said surface condition is a surface potential of said recording medium.

9. An image forming apparatus comprising:

image forming means for forming an image on a recording medium;

detecting means for detecting a surface condition of said recording medium;

control means for controlling said image forming means so as to provide a proper image forming condition in accordance with an output of said detecting means, said control means being arranged to carry out an arithmetic processing for the output value from said detecting means in accordance with a predetermined arithmetic expression, and to operate said image forming means in accordance with the arithmetic processing result; and correcting means for correcting the coefficient of said arithmetic expression, if said image forming means is inoperative exceeding a predetermined time.

10. An image forming apparatus according to claim 9, wherein said image forming condition is an electric charging characteristic of said recording medium.

11. An image forming apparatus according to claim 9, wherein said correcting means measures the rising variation of a sensitivity characteristic of the recording medium, and corrects the coefficient of said arithmetic expression in accordance with the measured rising characteristic.

12. An image forming apparatus according to claim 9 wherein said image forming means includes an exposure lamp for exposing an original, and said coefficient pertains to a turn on voltage of said exposure lamp.

13. An image forming apparatus according to claim 9, wherein said image forming means includes a charger for charging said recording medium, and said coefficient pertains to a charging current of said charger.

14. An image forming apparatus according to claim 9, wherein said image forming means includes a developer for developing a latent image formed in said recording medium, and said coefficient pertains to a developing bias voltage to be applied to said developer.

15. An image forming apparatus according to claim 9 wherein said surface condition is a surface potential of said recording medium.

* * * * *